US005522359A

United States Patent [19]

Collin

[11] Patent Number: 5,522,359

[45] Date of Patent: Jun. 4, 1996

[54] METHOD OF OPERATING A DIESEL ENGINE, AND DIESEL ENGINE

[75] Inventor: Lars T. Collin, Mölndal, Sweden

[73] Assignee: Lars Collin Consult AB, Molndal, Sweden

[21] Appl. No.: 396,587

[22] Filed: Mar. 1, 1995

Related U.S. Application Data

[63] Continuation of Ser. No. 32,001, Mar. 16, 1993, abandoned.

[30] Foreign Application Priority Data

Mar. 20, 1992 [CH] Switzerland ..... 901/92

[51] Int. Cl.[6] ..... F02B 5/00

[52] U.S. Cl. ..... 123/305

[58] Field of Search ..... 123/305, 294, 123/27 R, 501

[56] References Cited

U.S. PATENT DOCUMENTS

| | | | |
|---|---|---|---|
| 2,534,322 | 12/1950 | Thaheld | 123/27 R |
| 3,125,076 | 3/1964 | Mullaney | 123/27 R |
| 4,359,025 | 11/1982 | Zeliszkewycz | 123/294 |
| 4,883,032 | 11/1989 | Hunter et al. | 123/276 |
| 4,899,699 | 2/1990 | Huang et al. | 123/305 |
| 4,924,828 | 5/1990 | Oppenheim | 123/305 |
| 5,012,786 | 5/1991 | Voss | 123/467 |
| 5,265,562 | 11/1993 | Kruse | 123/27 R |

FOREIGN PATENT DOCUMENTS

| | | | |
|---|---|---|---|
| 3032656 | 8/1980 | Germany | 123/305 |

OTHER PUBLICATIONS

Prof. IR. J. J Broeze, Combustion in Piston Engines, 1963, 234–243.

*Primary Examiner*—Raymond A. Nelli
*Attorney, Agent, or Firm*—Shoemaker and Mattare, Ltd.

[57] ABSTRACT

With a device for operating a diesel engine, compression, fuel injection and ignition are controlled in such a way that the maximum total pressure in the cylinder, after ignition of the mixture, in principle no longer increases.

1 Claim, 3 Drawing Sheets

METHOD OF OPERATING A DIESEL ENGINE, AND DIESEL ENGINE

Figure 1:
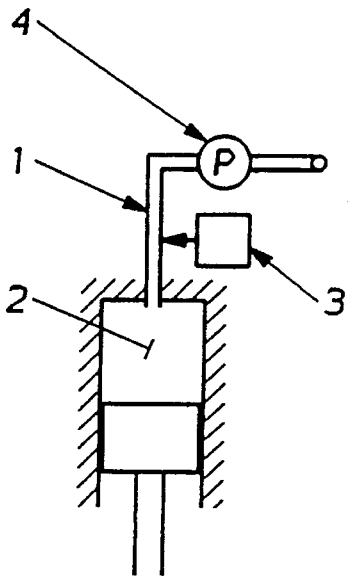

This application is a continuation of U.S. application Ser. No. 08/032,001, filed Mar. 16, 1993, now abandoned.

Methods and devices for injection and ignition of diesel fuel in a combustion engine are numerously known and in use. In practice, in these cases the fuel is raised to a certain injection pressure by a pump and at the same time the injection valve is opened. Here, as with the injection pump, the valve can be actuated with a device which is synchronised with the engine. Embodiments are also in use with which the valve automatically opens, dependent on the fuel pressure, as soon as a certain pressure value is exceeded.

In practice, current injection valves are opened by the injection pump at commencement of the pressure build-up, and closed once again after the pressure drops. In the case of pressure controlled valves, the opening value is generally 20% or 30% of the maximum working pressure of the fuel pump.

The air/fuel mixture is then further compressed, prior to ignition. In the case of known engines, at the same time combustion pressure builds up immediately after the piston reaches top dead centre (TDC), said pressure amounting to 1,5 to 2,0 times the compression of the engine.

These types of engines possess good efficiency. On the other hand, parameters which ensure good efficiency are frequently suitable for the promotion bad emission values (mainly $NO_x$). In addition, for example temperature, excess oxygen during combustion, combustion pressure and duration of combustion are related factors.

In order to reduce the creation of $NO_x$, different methods are known:

Recirculation of exhaust gases has been suggested, in order to reduce the $\mathbf{0}_2$ concentration and with that the maximum temperature: Spraying of water into the intake air has been suggested, in order to reduce the compression temperature and to lower the $\mathbf{0}_2$ concentration. It has already been suggested that the timing of the injection should be retarded in order to reduce the time for $NO_x$ formation during the engine's cycle.

All these known methods are on the one hand extravagant, and demand additional devices, and on the other hand they can reduce the efficiency of the engine.

The invention has the purpose of avoiding the disadvantages of the known methods, thus in particular of creating a method which restricts the emission of the polutant $NO_x$ and maintains high levels of efficiency.

According to the invention, this purpose is fulfilled primarily according to the patent claims.

Through the steps according to the invention, a plurality of parameters concerning the combustion procedure are altered in an advantageous way:

Through the limitation of the pressure rise during combustion, no pressure determined additional rise in temperature, respectively an excessive rise in temperature, will occur during combustion, through which mainly the creation of $NO_x$ is considerably reduced. Instead of a sharp increase in pressure and temperature at commencement of energy release, a controlled combustion sequence will ensue in the cylinder, which, by means of the simultaneous volume enlargement during lowering of the piston, makes possible an approximately constant or, with advantage, even a gentle descent of the pressure curve. This necessitates a higher compression for the engine, compression ratios of 1:16 to 1:20, preferably 1:18 to 1:20 and/or compression up to 175 bar or 180 bar having proved themselves successful. With that, the engine is compressed to these high compression values, and the ignition procedure is brought about within the expansion phase.

As is well known, the combustion chamber pressure depends not only on the mechanical compression ratio, but also on the amount of supercharging and the efficiency of any intercooling. The preferred compression ratios mentioned above are for an engine turbocharged at about 3.5 bar. Depending on the degree of turbocharging and the value of the compression ratio, the compression within the cylinder may increase above 175 bar.

At the same time, according to the invention, it is anticipated that the fuel is only injected into the combustion chamber if the fuel pressure has reached at least 75%, and preferably between approximately 80% and 90% of its maximum injection pressure. This causes shortening of the duration of injection, better distribution of fuel in smaller droplets, and thus more rapid carburetion of the fuel. This, in turn, leads to homogenous conditions in the combustion chamber and ensures uniform combustion. The combustible mixture is created within a considerably shorter time span. In addition, delay in the case of pre-combustion reactions between the hydrocarbons and oxygen is shortened, and combustion is optimised. With that, considerable improvement can already be achieved if the valve is only opened when the fuel pressure has reached at least 80% of its maximum injection pressure.

Figure 2:
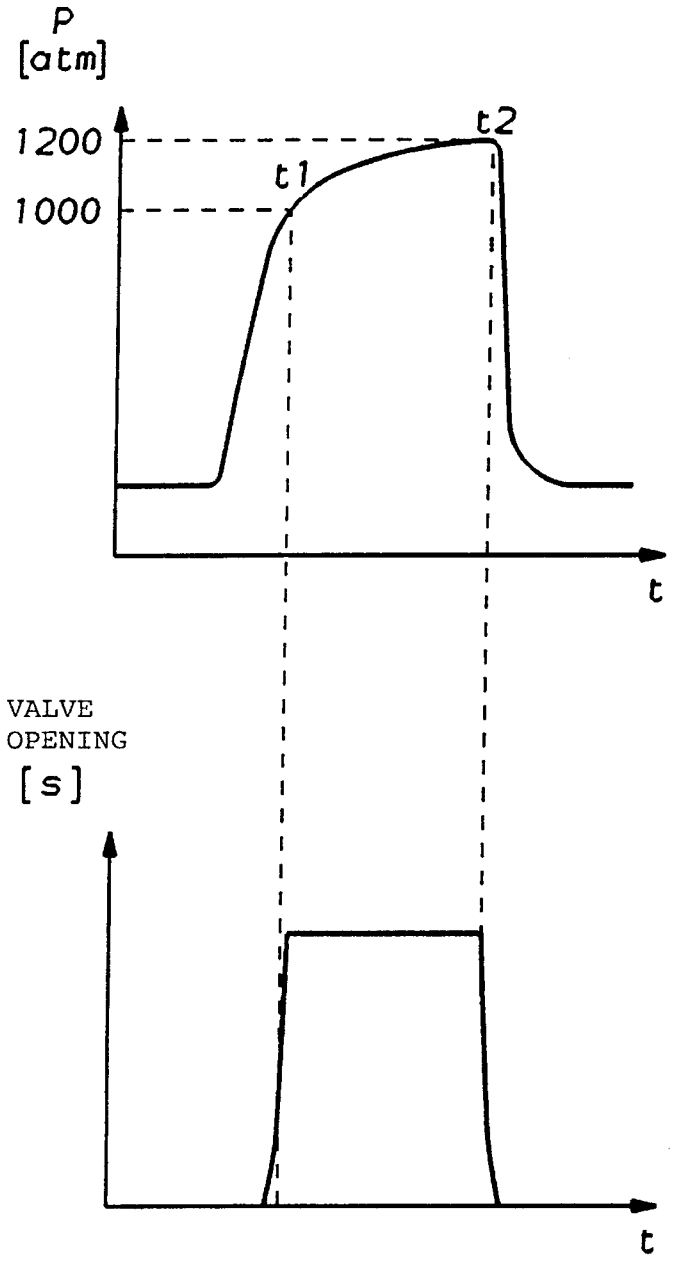
Figure 3:
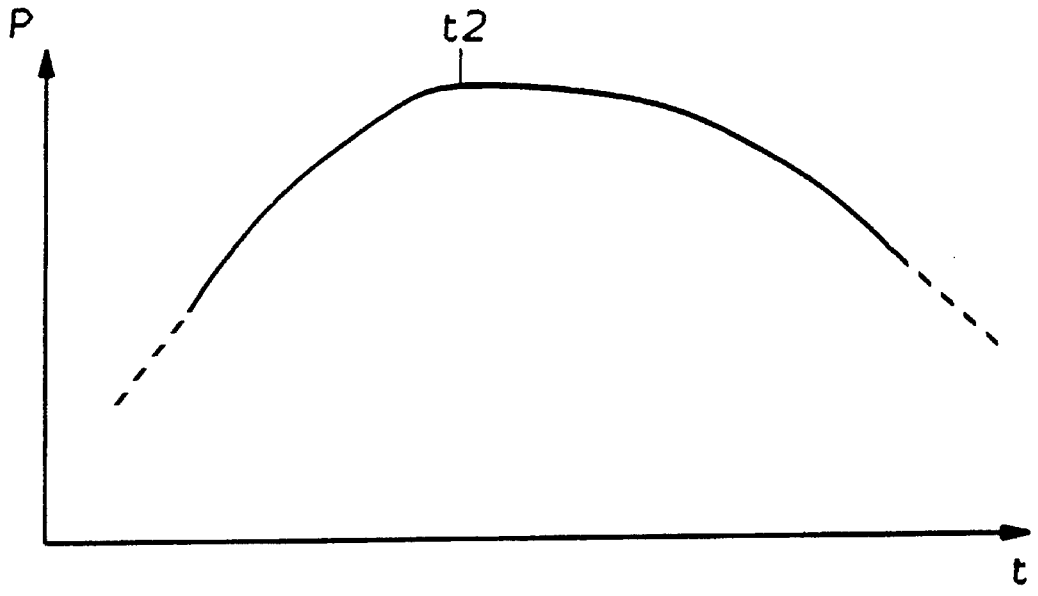
Figure 4:
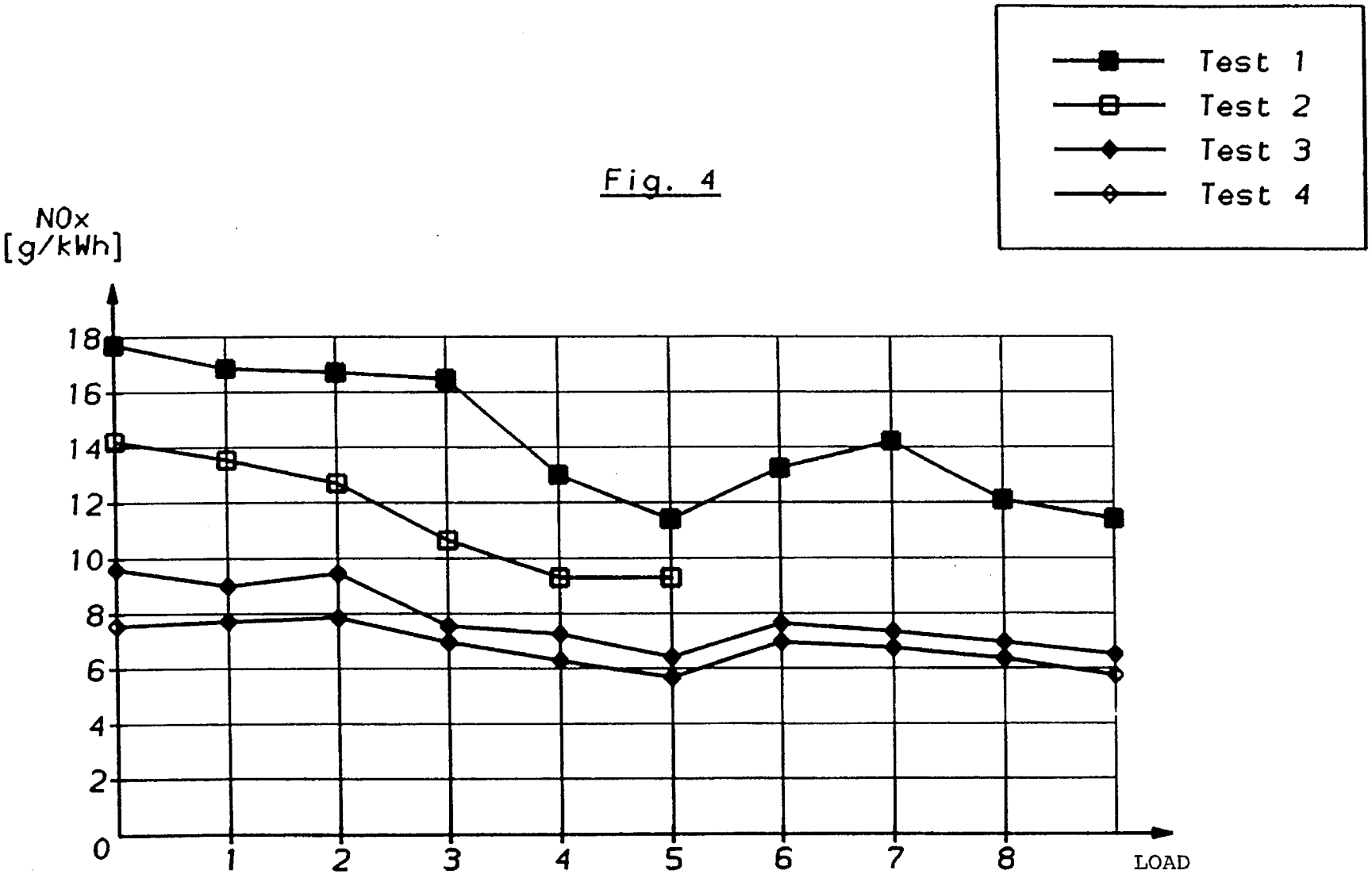

The invention is more closely described in the following examples, illustrated by the drawings. Namely:

FIG. 1 a schematic representation of a section through an internal combustion engine, FIG. 2 the valve opening sequence, dependent on fuel pressure, FIG. 3 a schematic representation of the pressure sequence within the combustion chamber of the diesel engine at the instant of ignition, and FIG. 4 a diagram with comparative values of the proportion of $NO_x$ in the exhaust of an internal combustion engine under different operating conditions.

As schematically represented in FIG. 1, fuel is introduced into the combustion chamber 2 of a schematically represented diesel engine by means of an injection valve 1. The injection valve 1 is opened at the desired instant during the combustion cycle by means of a control arrangement 3. The injection valve 1 is fed with fuel by a pump 4, the pump likewise being controlled depending on crank angle, respectively from the respective instant during the engine cycle. The fuel pressure produced by the pump 4 amounts to a maximum of approximately 1000 to 1500 atm (atmospheres).

(The maximum pressure ranges with different engines from approximately 200 atm to 1700 atm. In the same way, the build-up characteristic of the fuel pressure curve can vary).

The fuel pressure sequence is represented in FIG. 2. Whilst with conventional diesel engines the injection valve opens by means of the pump 4 at commencement of the pressure build-up (at the latest at 200–300 atm), according to the invention it is anticipated that the injection valve 1 only opens at instant T1, if the fuel pressure directly adjacent to the injection valve has already reached 1000 atm, i.e. approximately 83% of the maximum pressure of approximately 1200 atm. Through the high pressure, the diesel fuel is injected into the combustion chamber 2 at an exceptionally high speed and above all with the smallest possible droplet diameter, so that the combustion sequence is optimised and above all is also shortened. The injection valve 1 closes again at T2, the fuel pressure amounting still to approximately 900–950 atm, thus more than 70% of the maximum pressure. This ensures that large fuel droplets, which could adversely influence the combustion sequence in the closing phase, do not continue to be injected during the closing phase.

Independent from the specific maximum pressure of a specific engine type, the polutant characteristics of the engine will be improved through the relative raising of the pressure during the injection phase.

It can be seen in FIG. 3 that the pressure build-up in the combustion chamber of a diesel engine operated according to the invention ensues continuously until the instant of ignition, and gradually levels out. The instant of ignition T2 is relatively late, so that expansion of the ignited gas cloud falls within the expansion phase of the engine. In this way it is achieved that no principle pressure build-up will ensue after ignition, through which additional heating through pressure increase during combustion is avoided. In this way the egress of polutants, above all the $NO_x$ content of the exhaust gas, can be drastically reduced in an optimally simple way. This can be achieved by simple means: the compression of the engine must be raised to a value which enables late ignition and gas expansion to occur within the expansion phase of the engine. Thus, merely the most important combustion parameters, such as compression, fuel injection, and ignition must be controlled in such a way that the total pressure in the cylinder, comprising compression and combustion pressure, does not exceed the maximum compression to any considerable degree, therefore that no further increase in pressure after ignition will ensue. A gentle build-up, e.g. of around 10%, can, with that, not be avoided at times. It is particularly optimal, however, if the pressure in the combustion chamber, from the instant of ignition onwards, no longer builds-up, but rather even reduces somewhat, as is shown in the diagram according to FIG. 3.

FIG. 4 shows a comparitive test on a conventional diesel engine. The engine was operated at different rotational speeds/loading conditions 1 to 8, and, with that, the $No_x$ emission in grams $NO_x$/kWh was measured and recorded. The uppermost curve shows test 1, with which the engine was driven in an unaltered condition. The opening pressure of the injection valve amounts here to 280 atm; the injection commences pressure build-up at 20 degrees before TDC, and the compression ratio amounts to 1:13.

With the second test, both the initial parameters were left unchanged, and merely the compression ratio was raised to 1:16. Evidently, here a reduction in $NO_x$ content can already be recorded.

With the third test, the injection pressure is still at 280 atm; now, however, injection commences pressure build-up only at 14 degrees before TDC, and injects in the region of TDC. By this means, the instant of ignition is retarded in such a way that combustion falls within the expansion phase of the engine. With this test, no pressure increase takes place in the cylinder after ignition. The compression ratio amounts to 1:18.

With the lowermost and final test, both the instant of injection and the compression ratio as in test 3 have been repeated. The opening pressure of the valve was, however, raised to 900 atm, which once again evidently causes a lowering of the $NO_x$ emission.

As the diagram according to FIG. 4 reveals, a reduction of the $NO_x$ emission to a half value can be achieved in the most simple way and without large alterations to the engine. With that, only an inconsiderable, in practice negligible increase in consumption was observed.

Inasmuch as the invention is subject to modifications and variations, the foregoing description and accompanying drawings should not be regarded as limiting the invention, which is defined by the following claims and various combinations thereof:

I claim:

1. A method of reducing NOx emissions from a conventional diesel engine having a compression ratio in the range of 16:1 to 20:1, and having a fuel pump and intermittent fuel injectors which inject fuel into the engine's combustion chambers, said method comprising steps of supplying said injectors with fuel at a maximum pressure of at least 1000 bar, and, during each compression-combustion-expansion cycle, opening each said injector only (a) after the fuel pressure has reached at least 75% of said maximum pressure, and the contents of the cylinder has been compressed up to a compression pressure of at least 175 bar, to finely atomize the fuel, and (b) sufficiently late in the cycle that the fuel burns in the cylinder during the expansion stroke at a pressure which is not substantially higher than said compression pressure, to limit peak combustion temperatures, whereby production of oxides of nitrogen is reduced Without reducing engine efficiency.

* * * * *